US005301587A

United States Patent [19]

Blaimschein

[11] Patent Number: 5,301,587

[45] Date of Patent: Apr. 12, 1994

[54] METHOD AND CUTTING ASSEMBLY FOR MANUFACTURING THREE-DIMENSIONAL SHAPED PIECES FROM A PRE-FABRICATED BLOCK OF A MATERIAL HAVING LARGE PORES

[75] Inventor: Gottfried Blaimschein, Steyr, Austria

[73] Assignee: GFM Gesellschaft für Fertigungstechnik und Maschinenbau Aktiengesellschaft, Steyr, Austria

[21] Appl. No.: 967,510

[22] Filed: Oct. 28, 1992

[30] Foreign Application Priority Data

Oct. 30, 1991 [AT] Austria ..... 2156/91

[51] Int. Cl.[5] ..... B26D 3/28

[52] U.S. Cl. ..... 83/870; 83/34; 83/39; 83/49

[58] Field of Search ..... 83/13, 870, 39, 701, 83/861, 862, 49, 697, 34; 409/131, 132; 51/59.55, DIG. 11

[56] References Cited

U.S. PATENT DOCUMENTS 2,825,186 3/1958 Palush ..... 51/59.55
2,990,616 7/1961 Balamuth et al. ..... 51/59.55
3,999,453 12/1976 Damast et al. ..... 83/701

FOREIGN PATENT DOCUMENTS 0088591 1/1957 Norway ..... 83/870

*Primary Examiner*—Richard K. Seidel
*Assistant Examiner*—Allan M. Schrock
*Attorney, Agent, or Firm*—Collard & Roe

[57] ABSTRACT

Method of cutting a three-dimensional shaped piece of a material having large pores out of a block by trimming the block with adjacent cuts of a predetermined width guided along planes extending tangentially to the surface of the shaped piece whereby scrap of the material is produced, and cutting kerfs into the scrap no later than the trimming along planes extending radially relative to the shaped piece surface and longitudinally substantially parallel to each other, the cutting planes being spaced from each other at the shaped piece surface a maximum distance corresponding to the predetermined width of the adjacent cuts. For this purpose, an ultrasound assembly may be used, which comprises a knife which has a shaft portion extending in the direction of vibration of the knife and a cutting portion attached to the shaft portion and extending transversely to the direction of vibration, the shaft portion and the cutting portion having cutting edges.

4 Claims, 1 Drawing Sheet

Figure 1:
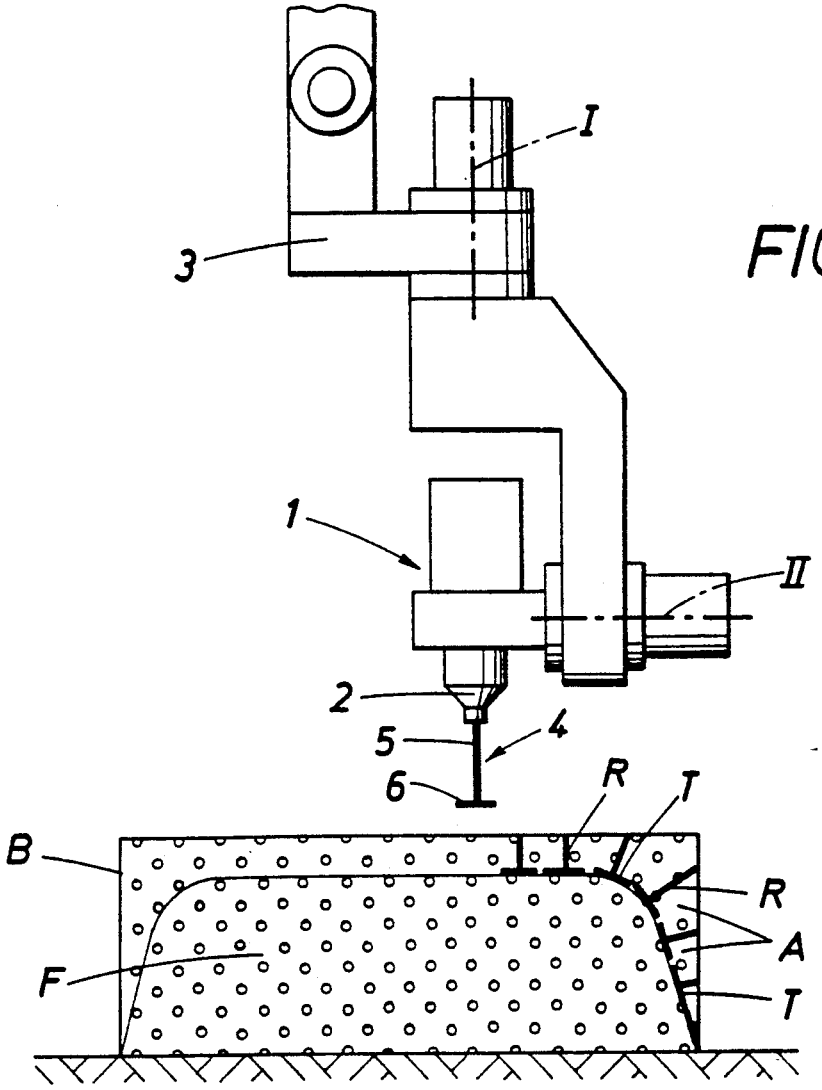

METHOD AND CUTTING ASSEMBLY FOR MANUFACTURING THREE-DIMENSIONAL SHAPED PIECES FROM A PRE-FABRICATED BLOCK OF A MATERIAL HAVING LARGE PORES

The invention relates to a method for manufacturing three-dimensional shaped pieces of a material having large pores, particularly honeycomb, after a block of this material has been trimmed by adjacently guided cuts of a predetermined cutting width along planes extending tangentially to the surface of the shaped piece to be manufactured, as well as to a cutting assembly for carrying out this method.

In the aircraft and car industries, as well as in instrument and machine construction, work piece bodies which contain within a load-bearing outer layer of a fiber-reinforced synthetic material a core of a light material, which is preferably stable in a direction extending perpendicularly to the outer layer, such as honeycomb, or another porous material, such as a foamed material, are processed to an increasing extent. Therefore, these shape-determined cores must be prepared as proper shaped pieces, for which purpose these shaped pieces are most often cut out of prismatic blocks of the core material by cutting tools, primarily saw blades which, however, permit only a very difficult and coarse shaping. It has also been proposed to use a rotary tool, which is comprised of a cutting disc and a material comminuting device arranged thereabove, for trimming the blocks so that the scrap material is comminuted simultaneously with cutting out the shaped pieces and the scrap does not interfere with the operation. However, these tools produce a considerable amount of dust because of the comminution of the material and make it more difficult to remove the scrap because of the turbulence of the scrap pieces.

It is the object of the invention to obviate these disadvantages and to provide a method of the first-indicated type, which permits a clean, automatic manufacture of the shaped pieces. In addition, a cutting assembly for the rational effectuation of the method is provided.

The invention accomplishes this object by cutting into the block to the surface of the shaped piece before the tangential trimming or during the tangential trimming substantially along planes extending radially relative to the surface of the shaped piece, the kerfs extending longitudinally substantially parallel to each other and having a maximum distance from each other at the surface of the shaped piece, which corresponds to the width of the cut of the tangential cuts. These radial kerfs prepare the block for the operation of the tool for the tangential trimming since the paths defined by the kerfs make the trouble-free guidance of the tools along the respective tangential planes possible. It is possible to move the tool along the kerfs through the block and to make the cut required for shaping the piece without comminuting the scrap, the scrap which has already been cut into ribbons by the kerfs being simultaneously cut off in ribbon pieces and being produced as scrap which can be easily handled and disposed. It is possible to make the radial kerfs simultaneously with the tangential trimming but they may also be made before the tangential trimming.

While material having large pore is difficult to divide by cuts with a knife, excellent cutting efficiency and quality have been obtained with a knife vibrating at an ultra-sound frequency in the radial and tangential cutting. Therefore, the method may be rationally effectuated with a cutting assembly comprising a knife-equipped sonotrode or the like, whose knife has a shaft portion extending in the direction of vibration and a cutting portion attached thereto and extending transversely to the direction of vibration, the shaft portion and the cutting portion defining cutting edges so that the knife may be used simultaneously for cutting tangentially and radially. Therefore, the contours of shaped pieces can be cut out directly from the pre-fabricated block by suitably guiding the knife during cutting and the scrap is immediately cut off in ribbons during the cutting out of the shaped piece. Of course, the radial and tangential cuts could be made with separate knives, which permits sequential radial and tangential cuts.

If the cutting edge of the shaft portion is recessed from the cutting edge of the cutting portion in the cutting direction, the scrap is detached from the remaining shaped piece in sections when the knife is advanced through the tangential cut before the radial cut is made so that the ribbon pieces may be more easily laterally split when the scrap is cut off and a better guidance of the knife may be obtained.

Useful forms of knives may be obtained with a cutting portion consisting of an elongated knife platelet centrally disposed on the shaft portion, in which the knife platelet may have bent-up ends, or with a cutting portion consisting of a disc with a circumferentially extending cutting edge, in which the disc may be circular but also elliptical, kidney-shaped or the like.

Figure 2:
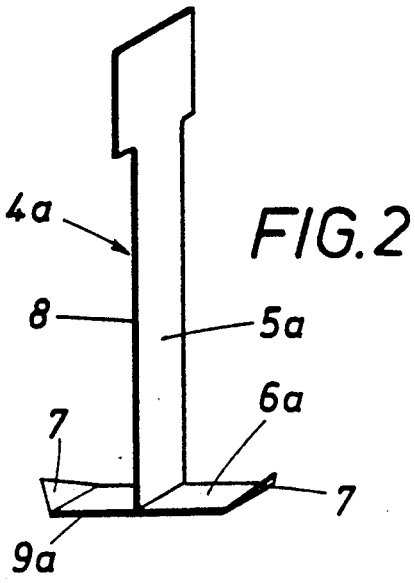
Figure 3:
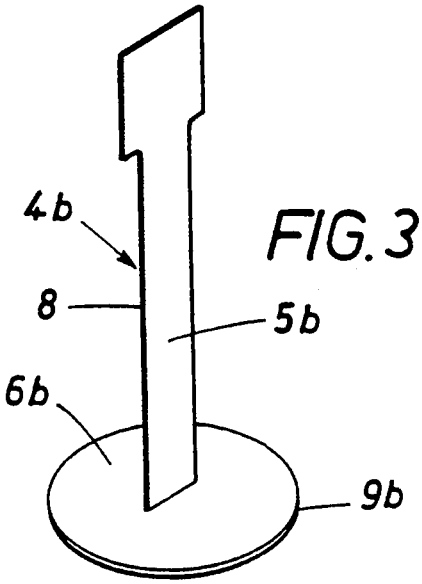

The subject matter of the invention is purely schematically illustrated in the drawing wherein FIG. 1 shows a cutting assembly according to the invention for the manufacture of a shaped piece in side elevation, partly in section, and FIGS. 2 and 3 are perspective views of respective embodiments of a knife for the cutting assembly.

To manufacture shaped pieces F of honeycomb or the like rationally, such shaped pieces F are cut out of a pre-fabricated block B of material for the shaped piece, for which purpose an ultrasound cutting assembly 1 is provided with a sonotrode 2 equipped with a knife, which is mounted rotatably adjustably about rotary axes I, II extending perpendicularly to each other on a robot arm 3 (not further illustrated) which is controllable along several axes whereby any desired movements, including three-dimensional cuts, may be effected.

As can be seen in FIG. 1, shaped piece F is cut out of block B by adjacent cuts T of a predetermined width along planes extending tangentially to the surface of the shaped piece to be manufactured while, before the tangential cutting or during the tangential cutting, kerfs R are made substantially along planes extending radially towards the surface of the shaped piece, the kerfs extending approximately parallel to each other and at a maximum distance corresponding to the width of the tangential cuts in the area of these cuts from each other. This results in the remaining scrap being cut off bit by bit from block B in the form of ribbons A as shaped piece F is cut out.

Radial kerfs R may be made with ultrasound cutting assembly 1 or a conventional incision knife, whereupon tangential cuts T are made by special knife 4. Knife 4 has a shaft portion 5 extending in the direction of vibration and a transversely extending cutting portion 6 at the end thereof so that the knife may be guided with its shaft portion 5 along radial kerfs R when cutting portion 6 is used for tangential cuts T. As is shown in FIG. 2 illustrating knife 4*a*, cutting portion 6 consists of an elongated knife platelet 6*a* centrally mounted on shaft portion 5*a*, ends 7 being bent upwards. As shown in FIG. 3, a knife 4*b* may have a cutting portion consisting of disc 6*b* centrally mounted on shaft portion 5*b* to constitute a knife which may cut in all directions.

To enable radial kerfs R to be made simultaneously with tangential cuts T, shaft portions 5*a*, 5*b* may also have cutting edges 8 so that each knife 4*a*, 4*b* has a cutting edge extending transversely to the direction of vibration, i.e. longitudinally extending cutting edge 9*a* of knife platelet 6*a* or circularly extending cutting edge 9*b* of disc 6*b*, and a cutting edge 8 of shaft portion 5*a* or 5*b* extending in the direction of vibration to execute the desired cuts extending perpendicularly to each other. If the cutting edge of the shaft portion is recessed relative to the cutting edge of the cutting portion in the direction of cutting, as is shown in connection with knife 4*b*, more favorable splitting effects in cutting off the scrap and a more accurate guidance of the knife are obtained.

What is claimed is:

1. A method of cutting a three-dimensional shaped piece of a material having large pores, which comprises the steps of (a) cutting the shaped piece out of a block of said material by trimming the block with adjacent cuts of a predetermined width guided along planes extending tangentially to the surface of the shaped piece whereby scrap of the material is produced, and (b) cutting kerfs into the scrap no later than the trimming along planes projecting from the shaped piece surface and being substantially perpendicular thereto, the planes defined by the cutting kerfs being spaced from each other at the shaped piece surface a maximum distance corresponding to the predetermined width of the adjacent cuts.

2. The manufacturing method of claim 1, wherein the kerfs are cut before the trimming.

3. The manufacturing method of claim 1, wherein the kerfs are cut during the trimming.

4. An ultrasound assembly for cutting a three-dimensional shaped piece of a material having large pores out of a block of said material, which comprises a knife vibratable in a direction of vibration, the knife comprising (a) a shaft portion extending in the direction of vibration and (b) a cutting portion attached to the shaft portion and extending transversely to the direction of vibration, (1) the shaft portion and the cutting portion having cutting edges, and (2) the cutting portion being an elongated knife platelet centrally mounted on the shaft portion and having upwardly bent ends.

* * * * *